United States Patent [19]

Nishimura et al.

[11] 4,201,166

[45] May 6, 1980

[54] AIR TO FUEL RATIO CONTROL SYSTEM FOR INTERNAL COMBUSTION ENGINE

[75] Inventors: Yutaka Nishimura; Yoshishige Oyama, both of Katsuta, Japan

[73] Assignee: Hitachi, Ltd., Japan

[21] Appl. No.: 952,737

[22] Filed: Oct. 19, 1978

[30] Foreign Application Priority Data

Oct. 20, 1977 [JP] Japan ..... 52-126438

[51] Int. Cl.[2] ..... F02M 7/12

[52] U.S. Cl. ..... 123/119 EC; 123/32 EA; 123/119 R; 261/121 B

[58] Field of Search ..... 123/119 EC, 32 EE, 32 EA, 123/119 R, 124 R, 119 D; 60/276, 285; 261/121 B, DIG. 69

[56] References Cited

U.S. PATENT DOCUMENTS

| | | | |
|---|---|---|---|
| 3,750,632 | 8/1973 | Zechnall | 123/32 EA |
| 3,949,714 | 4/1976 | Mitchell | 123/32 EA |
| 4,023,357 | 5/1977 | Masaki | 123/119 EC |
| 4,050,428 | 9/1977 | Masaki | 123/32 EA |
| 4,092,380 | 5/1978 | Pierlot | 261/121 B |
| 4,103,654 | 8/1978 | Nakamura | 123/119 EC |
| 4,111,170 | 9/1978 | Nakajima et al. | 123/124 R |
| 4,150,645 | 4/1979 | Berent | 123/119 EC |

FOREIGN PATENT DOCUMENTS

| | | | |
|---|---|---|---|
| 2611311 | 9/1976 | Fed. Rep. of Germany | 123/119 EC |
| 2719775 | 7/1978 | Fed. Rep. of Germany | 261/121 B |

*Primary Examiner*—Ronald H. Lazarus
*Assistant Examiner*—Jeffrey L. Yates
*Attorney, Agent, or Firm*—Craig and Antonelli

[57] ABSTRACT

An air to fuel ratio control system for an internal combustion engine having a fixed venturi type carburetor is disclosed. The air to fuel ratio control system comprises a device for extracting an atmospheric pressure within a venturi or a pressure corresponding to a relieved venturi vacuum, a device for extracting a static fuel pressure downstream of a main jet provided in a fuel path, a device for comparing those pressures directly or indirectly and a device for controlling the static fuel pressure in accordance with an output of the detecting device. Control is made such that the difference between those pressures is always maintained substantially constant. The air to fuel ratio control system may further comprise a device for detecting composition of exhaust gas of the engine. An output of the composition detecting device is applied to a control device which controls the static fuel pressure based on the output of the differential pressure detecting device and the output of the composition detecting device.

38 Claims, 24 Drawing Figures

AIR TO FUEL RATIO CONTROL SYSTEM FOR INTERNAL COMBUSTION ENGINE

BACKGROUND OF THE INVENTION

1. Field of the Invention

The present invention relates to an air to fuel ratio control system for a gasoline engine having a fixed venturi type carburetor.

2. Description of the Prior Art

The gasoline engine for an automobile requires fast response of the air to fuel ratio control system since operating condition of the engine frequently changes. A prior method for controlling an air to fuel ratio by sensing a change in composition of exhaust gas used in the air to fuel ratio control system has a drawback of slow response. Namely, since a certain period of time is taken before air-fuel mixture supplied from the carburetor to the engine passes through an intake pipe of the engine, a combustion chamber and an exhaust pipe and finally reaches an exhaust gas sensor, the rapid change of operating condition cannot be followed. If a gain of the control system is increased to overcome the above drawback, the air to fuel ratio control system will hunt and a proper control will not be attained. The closed loop control for the air to fuel ratio using the exhaust gas sensor is effective to the air to fuel ratio control in which the air to fuel ratio is corrected for slow change of environment such as secular change of metering of fuel for the carburetor, level change of ground or temperature change, but the development of control method having higher response and stability has been desired.

An air to fuel ratio control method which does not use the exhaust gas sensor is disclosed, for example, in the U.S. Pat. No. 3,750,632. In the method disclosed therein, the amount of suction air is measured by a heat radiation type or moving pressure plate type air flow meter to produce an electrical signal and based on this signal a desired flow rate of fuel is calculated by an electric circuit. On the other hand, an actual flow rate of fuel is sensed by a fuel flow meter, and the flow rate of fuel is controlled based on a difference between the desired flow rate and the actual flow rate of fuel. It would be expected that this control method attains better control response than the air to fuel control method using the exhaust gas sensor, but the signal produced from the air flow meter is not a linear function of the amount of intaking air while the signal from the fuel flow meter is proportional to the actual flow rate of fuel. Because of the use of different type of measurements, a complex linearizer is necessary in calculating the desired flow rate of fuel based on the intake air amount signal. Accordingly, the air to fuel ratio control system disclosed in the above U.S. Patent will be complex and expensive.

SUMMARY OF THE INVENTION

It is an object of the present invention to provide an air to fuel ratio control system having high response and stability suitable for use with a gasoline engine having a fixed venturi type carburetor.

It is a feature of the present invention to sense a static fuel pressure in a fuel feed path which is a function of a flow rate of fuel fed to the engine, sense an atmospheric pressure within a venturi which is a function of the amount of suction air, compare those pressures directly or indirectly and control a fuel flow rate based on a compare result so that a predetermined air to fuel ratio is attained. It is a further feature of the present invention to sense composition of exhaust gas of the engine and add the detected signal to the pressure comparison signal to control the fuel flow rate.

DESCRIPTION OF THE PREFERRED EMBODIMENTS

Figure 1A:
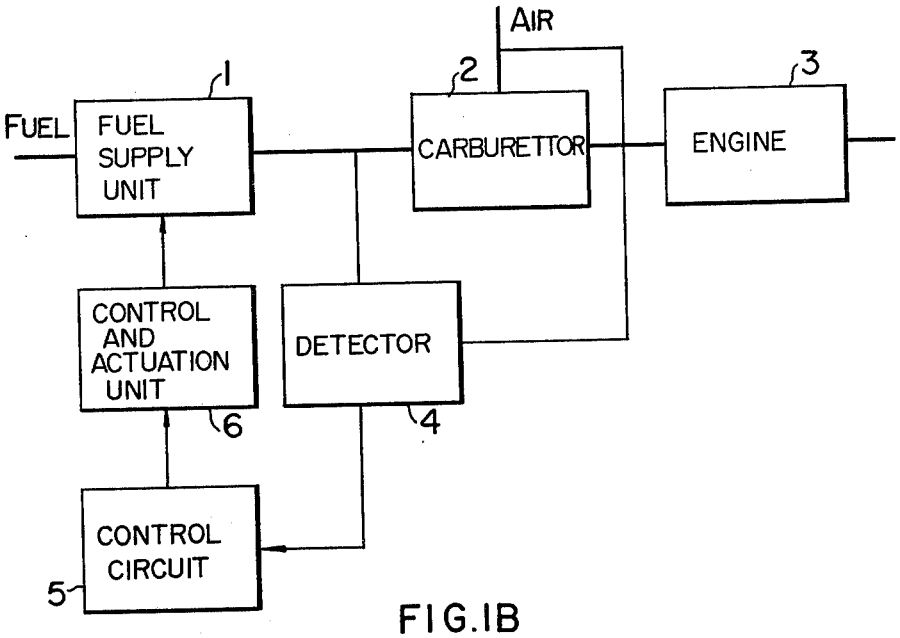
FIGS. 1A and 1B show block diagrams of an air to fuel ratio control system in accordance with the present invention.

Referring to FIG. 1A, gasoline is supplied to a carburetor 2 by a fuel supply unit 1 and mixed with air in the carburetor 2. Air-fuel mixture from the carburetor 2 is then supplied to an engine 3. A detector 4 senses the amount of fuel supplied from the fuel supply unit 1 and the amount of suction air in the carburetor 2 and produces a signal representative of a difference between those amounts. A control circuit 5 compares the signal from the detector 4 with a setting corresponding to a predetermined air to fuel ratio and supplies a control signal representative of the difference to a control and actuation unit 6, which adjusts the amount of fuel supplied from the fuel supply unit 1 in accordance with the control signal. The present air to fuel ratio control system senses the amount of supply of fuel and the amount of suction air to carry out feedback control for improving a control response.

Figure 1B:
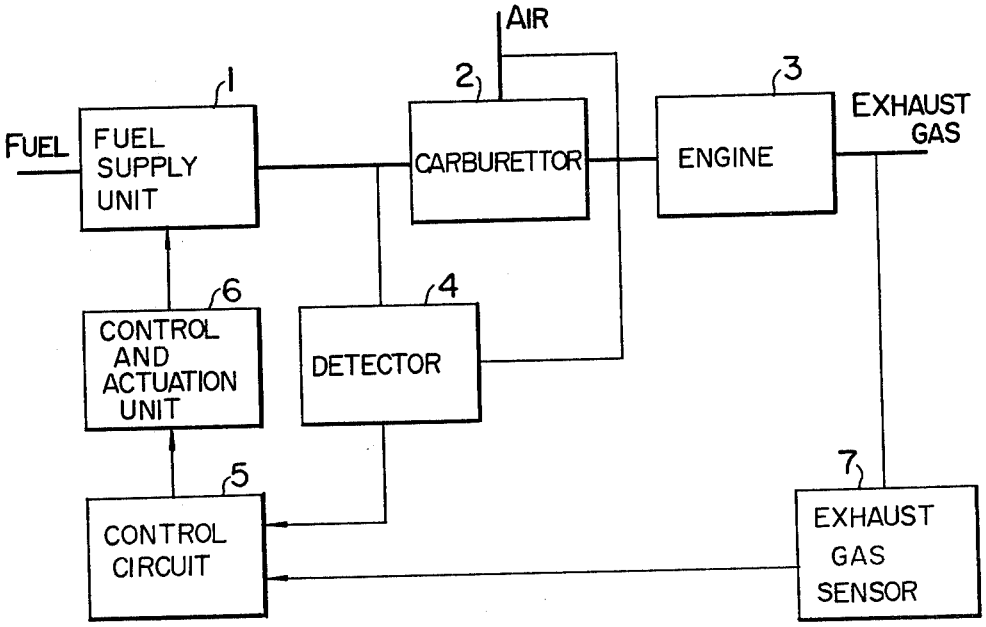

An air to fuel ratio control system shown in FIG. 1B incorporates air to fuel ratio control based on composition of exhaust gas to the control system shown in FIG. 1A. An exhaust gas sensor 7 senses composition of exhaust gas of the engine to produce a signal representative of the composition of the exhaust gas, which signal is supplied to the control circuit 5. The control circuit 5 compares the signal from the detector 4 and the signal from the exhaust gas sensor 7 with a setting to produce a control signal, which is supplied to the control and actuation unit 6. The present control system adds the feedback control by the output signal of the exhaust gas sensor 7 to the feedback control by the output signal of the detector 4 to improve the response of the air to fuel ratio control and maintain the stability and the precision of the control. In the control systems shown in FIGS. 1A and 1B, the detector 4 detects the amount of supply of fuel and the amount of suction air in terms of pressures in the respective paths.

Figure 2:
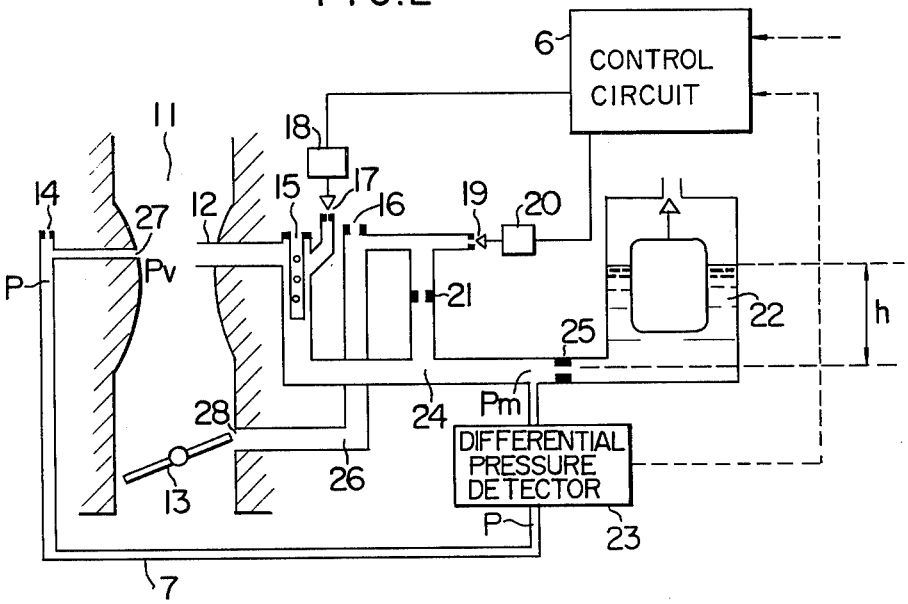
FIG. 2 shows one embodiment of the air to fuel ratio control system of the present invention.

FIG. 2 shows an embodiment of the air to fuel ratio control system in accordance with the present invention. A nozzle 12 for supplying fuel therethrough opens at a venturi of a suction tube 11 of the carburetor, and a throttle valve 13 is provided downstream of the nozzle 12. A main air bleed 15 and a feedback main air bleed 17 are provided in a main fuel path 24 which leads to the nozzle 12. The main fuel path 24 connects to a float chamber 22 through a main jet 25. A slow fuel path 26 which branches from the main fuel path 24 extends through a slow jet 21, a feedback slow air bleed 19 and a slow air bleed 16 and opens into the suction tube 11 near the throttle valve 13.

An opening 27 formed at the venturi leads to a differential pressure detector 23 through an air path 7 in which a venturi vacuum relieving air bleed 14 is provided. The differential pressure detector 23 is provided with a flow path to guide static fuel pressure downstream of the main jet 25. The differential pressure detector 23 may be a semiconductor pressure sensor having a silicon diaphragm, which produces an electrical signal representative of a difference between a venturi pressure enhanced by the air bleed 14 (that is, relieved venturi vacuum) and a pressure (static fuel pressure) downstream of the main jet. Since the venturi vacuum is so large compared with the vacuum downstream of the main jet and hence it is difficult to compare them with each other, the venturi vacuum is relieved in order to make the comparison easy and precise. The electrical signal from the detector 23 is applied to the control circuit 6 where it is compared with a predetermined reference and a control signal representative of a difference therebetween is produced. Cotnrolling actuators 18 and 20 respond to the control signal to control opening areas of the controlling air bleeds 17 and 19. As the feedback main air bleed 17 is closed, the vacuum downstream of the main jet 25 is the venturi vacuum relieved only by the main air bleed 15. As a result, a relatively large vacuum is produced. As a result, the amount of fuel supplied from the nozzle 12 through the main fuel path increases. On the other hand, as the feedback main air bleed 17 is opened, the vacuum downstream of the main jet is the venturi vacuum relieved by the main air bleed 15 and the feedback main air bleed 17. Therefore, it is a relatively small vacuum. As a result, the amount of fuel supplied from the nozzle 12 through the main fuel path decreases. Similarly, the amount of fuel supplied from the opening 28 through the slow fuel path 26 can be adjusted by controlling the opening area of the feedback slow air bleed 19. In the air to fuel ratio control of the present embodiment, the static fuel pressure Pm downstream of the main jet 25 and the pressure P which is the pressure Pv at the venturi enhanced by the venturi vacuum relieving air bleed 14 are compared in the differential pressure detector 23, and the opening areas of the feedback main air bleed 17 and the feedback slow air bleed 19 are controlled such that the differential pressure is always maintained constant under all operating conditions.

The air to fuel ratio control system of FIG. 2 is now theoretically explained. The pressure P applied to the differential pressure detector 23 can be expressed by:

$$P = Pv + C(Pa - Pv) \quad (1)$$

where

Pv: pressure at the venturi

Pa: atmospheric pressure $C = A_2^2/(A_1^2 + A_2^2)$ $A_1$: area of the opening 27 for the venturi pressure $A_2$: opening area of the venturi vacuum relieving air bleed 14

The following equations are also given:

$$V_a = C_a\sqrt{\frac{2g}{\gamma_a}(Pa - Pv)} \quad (2)$$

$$V_f = C_f\sqrt{\frac{2g}{\gamma_f}(Pa + \gamma_f \cdot h - Pm)} \quad (3)$$

where $V_a$: air flow velocity at the venturi $V_f$: fuel flow velocity at the main jet $\gamma_a$: specific gravity of air $\gamma_f$: specific gravity of fuel $C_a$: coefficient of air flow rate at the venturi $C_f$: coefficient of fuel flow rate at the main jet h: head difference between oil level in the float chamber and the main jet g: gravity acceleration On the other hand, when the differential pressure at the differential pressure detector 23 is replaced by gasoline column, that is, $P - Pm = \gamma_f l$, then from the above equations (1), (2) and (3) the air to fuel ratio A/F can be expressed by:

$$(A/F)^2 = \{\frac{(l-h)2g}{V_f^2} + \frac{1}{C_f^2}\} \times \{(\frac{d_a}{d_f})^4 \times \frac{\gamma_a}{\gamma_f} \times \frac{C_a^2}{1-C}\} \quad (4)$$

When it is assumed that $l-h=0$, the equation (4) is rewritten as follows:

$$(A/F)^2 = (\frac{C_a}{C_f})^2 (\frac{d_a}{d_f})^4 (\frac{\gamma_a}{\gamma_f}) \times \frac{1}{1-C} \quad (5)$$

where $d_a$: diameter of the air path at the venturi $d_f$: diameter of the path at the main jet Thus, when it is assumed that $l-h=0$ in the equation (4), the right term of the equation (4) is constant. Since h is a constant, the air to fuel ratio can always be maintained constant if the opening area of the feedback main air bleed 17 and the open area of the feedback slow air bleed 19 are controlled such that the differential pressure (P−Pm) detected by the differential pressure detector 23 assuems the constant value $\gamma_f h$. Under a normal operating condition, $V_a$ is large and the venturi vacuum is large. As a result, the vacuum downstream of the main jet is also large and hence $V_f$ is large. In the case, even if (l−h) is not exactly equal to zero, the air to fuel ratio A/F can be regarded to be substantially constant if $l-h \simeq 0$, as seen from the equation (4). Accordingly, by controlling such that the differential pressure (P−Pm) is substantially equal to $\gamma_f h$, that is, $l-h \simeq 0$, the air to fuel ratio can be maintained at the constant value defined by the equation (5). Furthermore, by changing the value C while controlling is being made to attain $l-h \simeq 0$, the air to fuel ratio setting can be changed as seen from the equation (5). Thus, by changing the value C depending on a particular operating condition, an air to fuel ratio adapted to that operating condition can be set. In addition to the signal from the differential pressure detector 23, a signal indicative of a temperature of engine coolant and a signal indicative of an aperture of the throttle value 13 are also supplied to the control circuit 6. Thus, when the temperature of the coolant is low such as at the start-up or when the aperture of the throttle valve is below a predetermined aperture or the throttle valve is almost fully open, the amount of supply of fuel is increased to attain a smaller air to fuel ratio than the set ratio.

Figure 3:
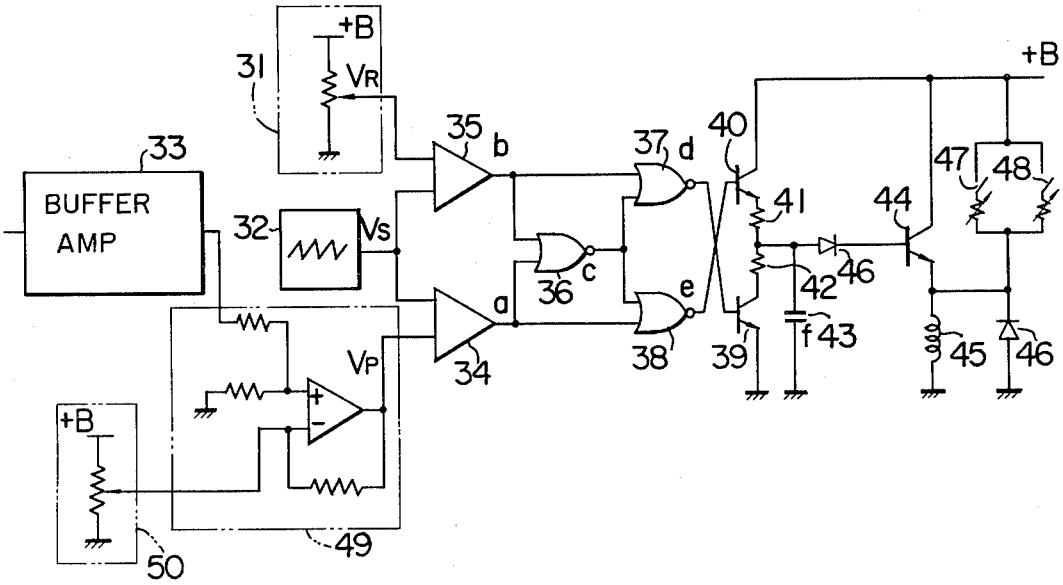
FIG. 3 shows an embodiment of a control circuit of the air to fuel ratio control system shown in FIG. 2.
Figure 4:
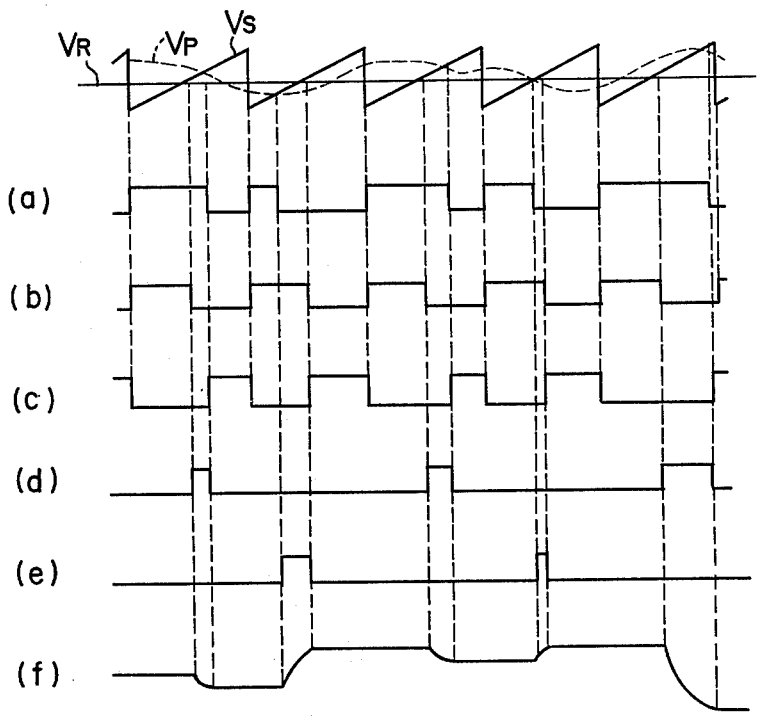
FIG. 4 shows waveforms for explaining the operation of the circuit of FIG. 3.

FIG. 3 shows an embodiment of the control circuit 6 shown in FIG. 2. The signal generated by the differential pressure detector 23 in FIG. 2 is applied to a buffer amplifier 33, thence to a subtractor 49 where a constant voltage from a constant voltage source 50 is substracted from the input signal. The subtractor 49 produces a voltage signal $V_p$ corresponding to P−Pm−K, where K is a constant. A reference voltage generator 31 produces a reference voltage signal $V_R$ corresponding to $\gamma_f h$. The voltage signals $V_P$ and $V_R$ are applied to a derivation-time conversion circuit comprising a sawtooth wave signal generator 32, comparators 34 and 35, and NOR gates 36, 37 and 38 and compared therein. The derivations of those signals are converted to signal durations. Namely, the comparator 34 compares the signal $V_P$ with a sawtooth wave signal $V_S$ to produce a signal shown at (a) in FIG. 4, and the comparator 35 compares the reference signal $V_R$ with the sawtooth wave $V_S$ to produce a signal shown at (b) in FIG. 4. The NOR gates 36, 37 and 38 produces output signals shown at (c), (d) and (e) in FIG. 4, respectively, The high level durations of the output signals (d) and (e) of the NOR gates 37 and 38, respectively, correspond to deviations of the signals $V_P$ and $V_R$, respectively. An integration circuit comprising transistors 39 and 40, resistors 41 and 42 and a capacitor 43 integrates the signals (d) and (e) to produce a signal shown at (f) in FIG. 4. The signal (f) controls the conduction of a transistor 44 which in turn controls a current flowing through a proportional solenoid valve 45 connected to the emitter of the transistor 44. The proportional solenoid valve 45 corresponds to the controlling actuators 18 and 20 shown in FIG. 2, and it operates to reduce the opening areas of the feedback main air bleed 17 and the feedback slow air bleed 19 as the current flwoing through the solenoid valve 45 increases or the signal $V_P$ becomes smaller than the signal $V_R$. The fact that the signal $V_P$ is smaller than the signal $V_R$ means that (P−Pm) is smaller than $\gamma_f h$, that is, the pressure Pm downstream of the main jet is larger than the desired value ($P+\gamma_f h$) and the amount of supply of fuel is too small. By reducing the opening areas of the feedback air bleeds 17 and 19, the pressure Pm downstream of the main jet can be reduced to the desired value ($P+\gamma_f h$). Since the signal $V_P$ corresponds to the differential pressure (P−Pm) less the constant K, the comparison of the signal $V_P$ and the reference signal $V_R$ cannot provide exact control for $P-Pm=\gamma_f h$, but the constant K is intended to compensate for the variations of the coefficients $C_a$ and $C_f$, as will be explained later and has a small value, and hence the influence thereof to the air to fuel ratio A/F can be neglected in an operation region in which more than predetermined amount of air and fuel are required. A diode 46 is inserted to protect the transistor 44.

When the temperature of the coolant is low such as at the start-up of the engine, or when the aperture of the throttle valve is below a predetermined aperture or almost fully open, it is necessary to reduce the air to fuel ratio A/F. A switch 47 may be a contact of a relay which is energized through a temperature switch (not shown) responsive to the temperature of the coolant, and a switch 48 may be a contact of a relay which is energized through a microswitch (not shown) which in turn is turned on in response to a predetermined aperture of the throttle valve. When any of the switches 47 and 48 is closed, a relatively large constant current flows through the proportional solenoid valve 45 so that the air to fuel ratio constant control loop by the comparison of the signal from the differential pressure detector 23 and the reference voltage signal is overrode. In this case, since the relatively large current flows through the proportional solenoid valve 45, the opening areas of the feedback main air bleed 17 and the feedback slow air bleed 19 are reduced to reduce the pressure Pm downstream of the main jet and increase the amount of supply of fuel.

Figure 5:
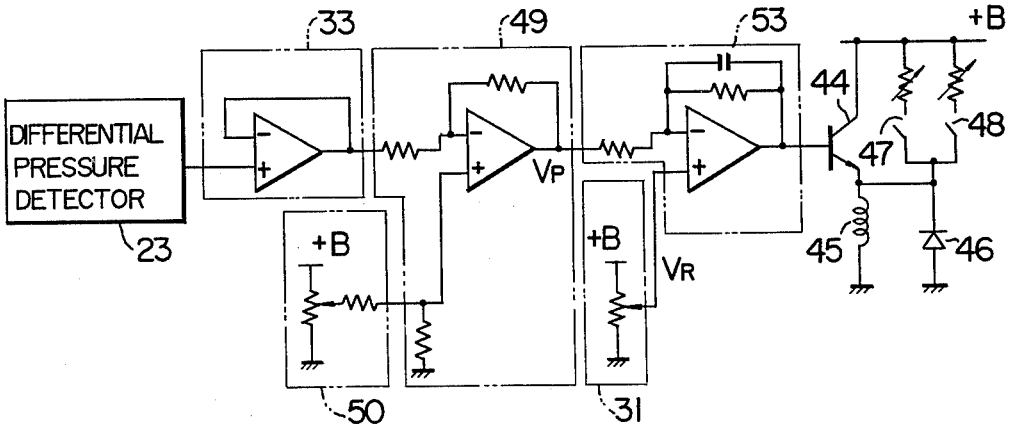
FIG. 5 shows another embodiment of a control circuit of the control system shown in FIG. 2.

FIG. 5 shows another embodiment of the control circuit 6. Like parts to those in FIG. 2 are designated by like numerals. The differential pressure signal from the differential pressure detector 23 in FIG. 2 is applied to the buffer amplifier 33, thence to the subtractor 49 where a constant voltage from the constant voltage source 50 is subtracted from the output voltage from the buffer amplifier 33 to produce a voltage signal $V_P$ corresponding to (P−Pm−K). The signal $V_P$ is applied to the integration circuit 53 where a difference between the signal $V_P$ and the reference voltage signal $V_R$ from the reference voltage generator 31 is integrated. The conduction of the transistor 44 is controlled by the output of the integration circuit 53, that is, the difference between the signal $V_P$ and the reference signal $V_R$. In this manner, the air to fuel ratio control similar to that in the embodiment of FIG. 3 is attained.

The control circuit of FIG. 5 integrates the difference between the signal $V_P$ and the reference signal $V_R$ to control the proportional solenoid valve while the control circuit of FIG. 3 converts the difference from the reference to the duration, which is integrated to control the proportional solenoid value. The purposes of operation of both control circuits are identical but the circuit of FIG. 5 is simpler.

When the control is carried out with this control circuit to attain $1-h \simeq 0$ as shown in the equation (5), the air to fuel ratio can be always maintained constant if $C_a/C_f$ is constant under all operating conditions. Actually, however, the air to fuel ratio in a low flow rate region tends to increase since $C_a/C_f$ deviates from the constant value in the low flow rate region.

Figure 6:
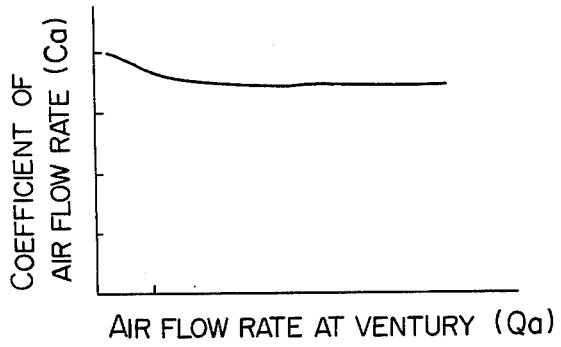
FIG. 6 shows a graph illustrating a relation between an air flow rate in a carburetor and a coefficient of air flow rate in a venturi.

FIG. 6 is a graph showing a relation between the air flow rate at the carburetor and the coefficient of the air flow rate at the venturi, in which an abscissa represents the air flow rate $Q_a$ at the venturi and an ordinate represents the coefficient $C_a$ of the air flow rate. As shown, when $Q_a$ is small, $C_a$ is large.

Figure 7:
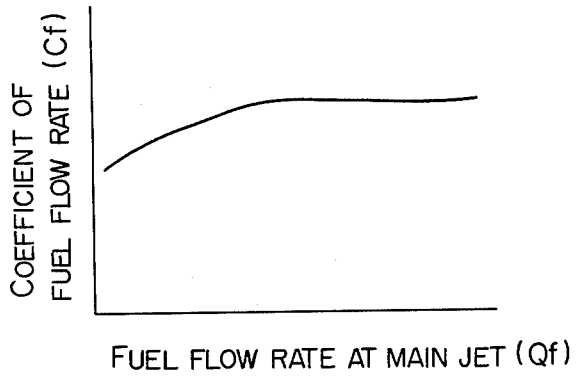
FIG. 7 is a graph showing a relation between a fuel flow rate of a main jet in a fuel feed path and a coefficient of fuel flow rate.

On the other hand, FIG. 7 is a graph showing a relation between the fuel flow rate at the main jet and the coefficient of flow rate, in which an abscissa represents the fuel flow rate $Q_f$ at the main jet and an ordinate represents the coefficient $C_f$ of the fuel flow rate. As shown, when $Q_f$ is small, $C_f$ is small. Accordingly, the ratio $C_a/C_f$ in the equation (5) is large and the air to fuel ratio A/F increases, when the flow rates of air and fuel are small. In order to present the variation of the air to fuel ratio, the constant voltage source 50 is provided in the embodiments of FIGS. 3 and 5 so that the constant value is subtracted from the differential pressure signal of the differential pressure detector 23 to produce the signal $V_P$ which is smaller than the actual detection signal. As a result, the amount of supply of fuel is increased to maintain the air to fuel ratio A/F constant.

Figure 8:
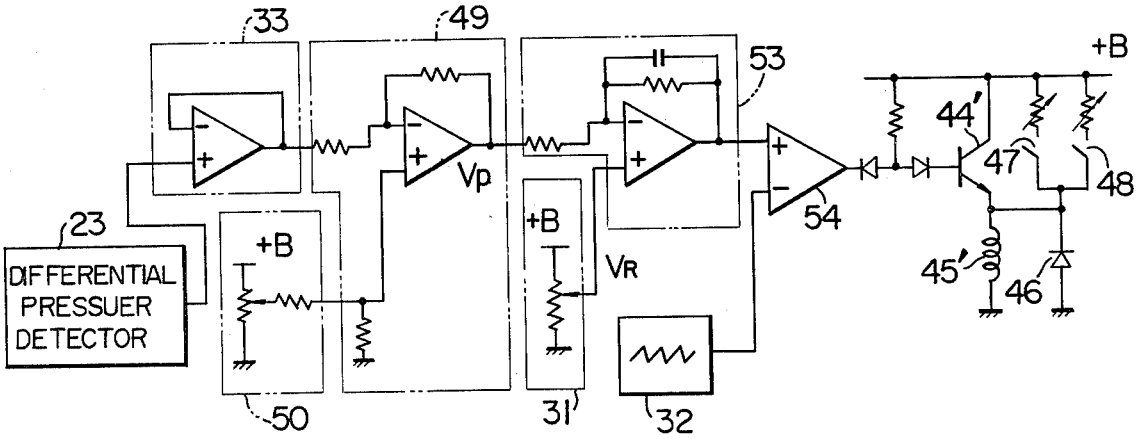
FIG. 8 shows a further embodiment of the control circuit of the air to fuel ratio control system shown in FIG. 2.

FIG. 8 shows another embodiment of the cntrol circuit 6, in which the proportional solenoid valve 45 used in FIGS. 3 and 5 has been replaced by an on-off solenoid valve 45' which is operated to be either turned on or turned off. In FIG. 8, like parts to those in FIGS. 3 and 5 are designated by like numerals. The output signal $V_P$ from the subtractor 49 is applied to the integration circuit 53 where the difference between the signal $V_P$ and the reference signal $V_R$ is integrated. The output from the integration circuit 53 is applied to a comparator 54 where it is compared with the sawtooth wave signal $V_S$. The comparator 54 produces a high level output signal when the output signal of the integration circuit 53 is larger than the sawtooth wave signal $V_S$. The output signal of the comparator 54 is applied to a base of a transistor 44' to turn it on. As the transistor 44' is turned on, the on-off solenoid valve 45' is energized to close the feedback air bleeds 17 and 19. The duration of the high level output signal of the comparator 54 is longer as the output of the integration circuit 53 increases. Therefore, the on period of the transistor 44', and hence the closed period of the feedback air bleeds 17 and 19 and longer and the amount of supply of fuel increases as the signal $V_P$ decreases. Consequently, when the signal $V_P$ is smaller than the signal $V_R$, it means that $(P-Pm)$ is smaller than $\gamma_f h$ and hence the pressure Pm downstream of the main jet is larger than the desired value $(P+\gamma_f h)$ and the amount of supply of fuel is too small. In this case, the control is made to increase the amount of supply of fuel.

In the air to fuel ratio control systems in accordance with the embodiments explained with reference to FIGS. 2 to 8, the feedback air bleeds are provided at the main air bleed and the slow air bleed of the fixed venturi type carburetor, and the solenoid valve (actuator) arranged to oppose to thsoe bleeds is energized by the differential pressure signal of the pressure proportional to the pressure at the venturi (suction air flow rate) and the static fuel pressure downstream of the main jet (fuel flow rate) to rapidly control the amount of supply fuel so as to maintain the air to fuel ratio at the predetermined value irrespective of the operating condition of the engine. At the time of the start-up of the engine where the temperature of the coolant of the engine is low, or at the time of heavy load operation of rapid acceleration where the aperture of the throttle valve is large, the air to fuel ratio constant conttol loop is released to make the air-fuel mixture richer.

Figure 9:
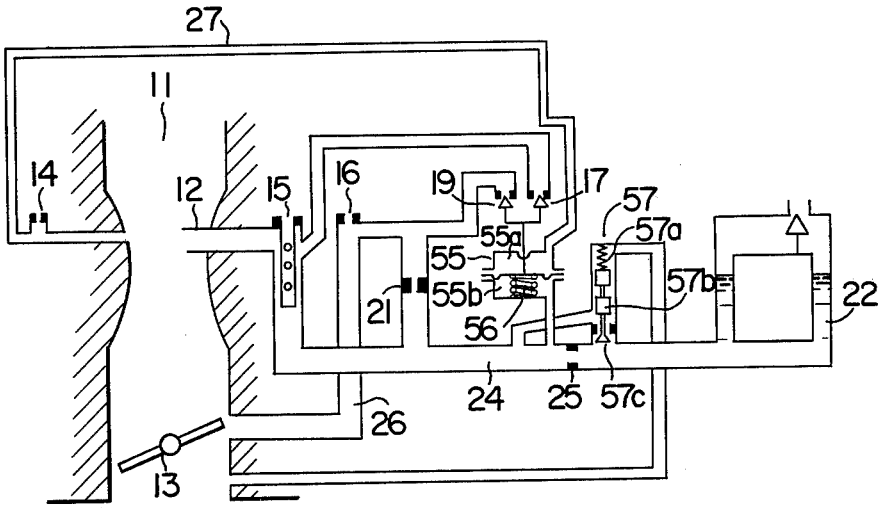
FIG. 9 shows another embodiment of the air to fuel ratio control system of the present invention.

FIG. 9 shows another embodiment of the air to fuel ratio control system of the present invention. In FIG. 9, like parts to those in FIG. 2 are designated by like numerals. The present embodiment is also applied to the fixed venturi type carburetor, but it performs mechanical control by a diaphragm valve without using electronic circuits. A differential pressure between the static fuel pressure downstream of the main jet 25 and the pressure at the venturi enhanced by the venturi vacuum relieving air bleed 14 is detected by a diaphragm valve 55 which includes a compressed spring 26 therein and two branching needles mounted to face the feedback air bleeds 17 and 19. A pressure P proportional to the venturi pressure is introduced into an upper chamber 55*a* of the diaphragm value 55 while the pressure Pm downstream of the main jet 25 is introduced into a lower chamber 55*b*. The opening areas of the feedback air fleeds 17 and 19 are controlled by the needles linked to the diaphragm so as to make the differential pressure $(P-Pm)$ to be always substantially equal to the constant value $\gamma_f h$. the compressed spring 56 functions to prevent the air to full ratio A/F from increasing in the low flow rate region of air and fuel. It is inserted in the lower chamber 55*b*. A compression force of the compressed spring 56 corresponds to the constant voltage of the constant voltage source 50 in FIGS. 3, 5 and 8, and it is added to the pressure Pm. A power mechanism unit 57 comprises a compressed spring 57*a*, a piston 57*b* and a valve 57*c*, and it moves the piston 57*b* downward to open the valve 57*c* to increase the amount of supply of fuel when the throttle valve 13 is opened above the predetermined operature such as at the time of heavy load operation.

Figure 10:
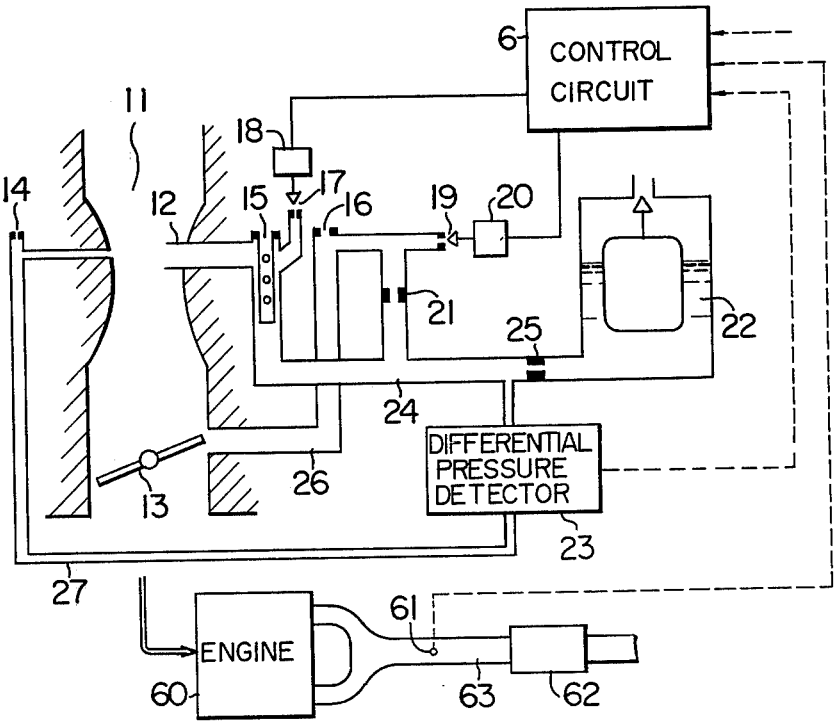
FIG. 10 shows a further embodiment of the air to fuel ratio control system of the present invention.

FIG. 10 shows a further embodiment of the air to fuel ratio control system of the present invention, in which a control system using an exhaust gas sensor is added to the air to fuel ratio control system shown in FIG. 2, to improve the precision and the stability of the air to fuel ratio control. In FIG. 10, like parts to those in FIG. 2 are designated by like numerals. An exhaust gas sensor 61 is mounted in an exhaust pipe 63 of an engine 60 and a catalyst tube 62 filled with catalyst is attached downstream of the exhaust gas sensor 61. A signal from the exhaust gas sensor 61 (e.g. oxygen sensor) is applied to the control circuit 6.

Figure 11:
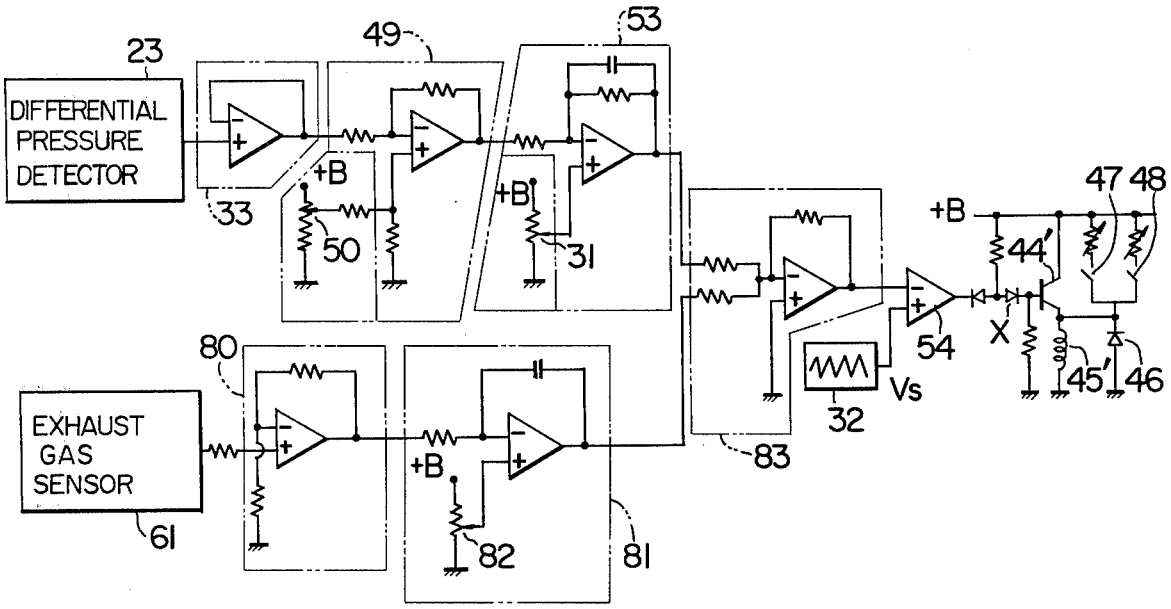
FIGS. 11 and 12 show embodiments of a control circuit of the air to fuel ratio control system shown in FIG. 10.

FIG. 11 shows an embodiment of the control circuit 6 of FIG. 10, in which an adder for adding the signal from the exhaust gas sensor 61 to the signal from the differential pressure detector 23 is added to the circuit shown in FIG. 8. The signal from the exhaust gas sensor 61 is amplified by an amplifier 80, thence it is supplied to an integrator 81 where a difference between the output signal of the amplifier 80 and a reference voltage signal from a reference voltage generator 82 is integrated. The output of the integrator 81 is applied to an adder 83 where it is combined with the output from the integrator 53. The output of the adder 83 is applied to the comparator 54 where it is compared with the sawtooth wave signal $V_S$. The comparator 54 produces a high level output when the sawtooth wave signal $V_S$ is larger than the output signal from the adder 83. The subsequent operation is similar to the operation described in conjunction with FIG. 8. The reference voltage of the reference voltage generator 82 in the present embodiment is set to correspond to the air to fuel ratio established in the embodiment of FIG. 2. The control in the present embodiment is equivalent to increase the control gain of the control system for detecting the differential pressure, and it can further improve the control response and compensate for the variation of the air to fuel ratio due to slow change of environment such as change of level of ground or change of temperature, and it further prevents hunting in the control system.

Figure 12:
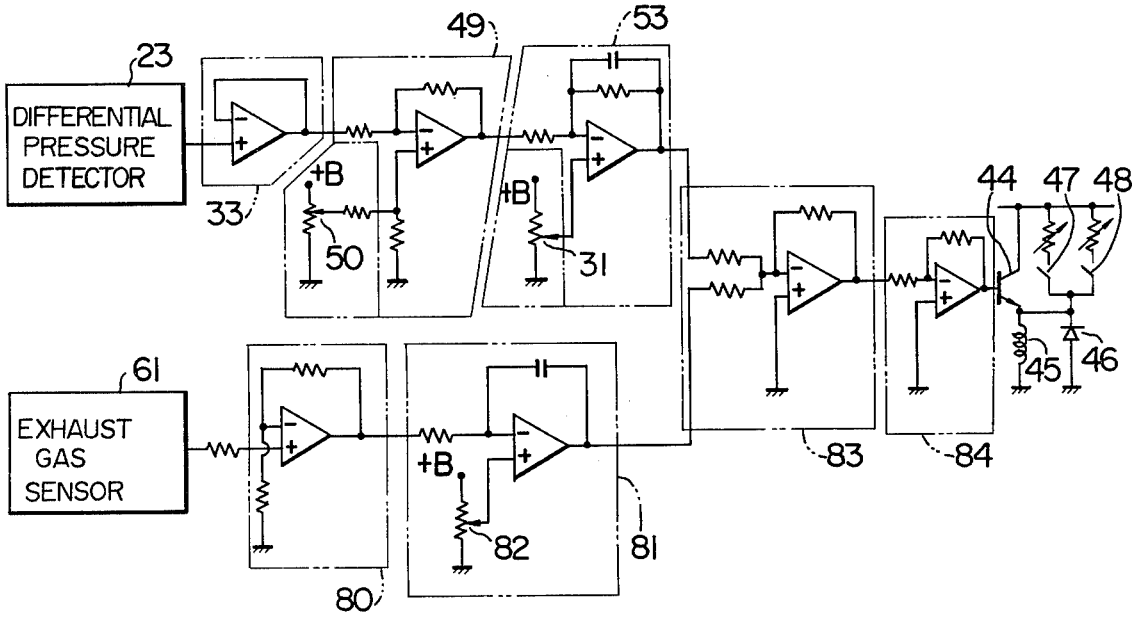

FIG. 12 shows another embodiment of the control circuit 6 of FIG. 10, in which an adder for adding the signal from the exhaust gas sensor 61 to the signal from the differential pressure detector 23 is added to the circuit shown in FIG. 5. The circuit shown in FIG. 11 uses the on-off solenoid value while the circuit shown in FIG. 12 uses the proportional solenoid value. The operation of the circuit will be readily understood from the description made in conjunction with FIGS. 3, 5 and 11, and hence it is not explained here. An inverter 84 is provided to invert the output signal of the adder 83 since the output signal of the adder 83 is an inverted version of the input signal thereto.

Figure 13:
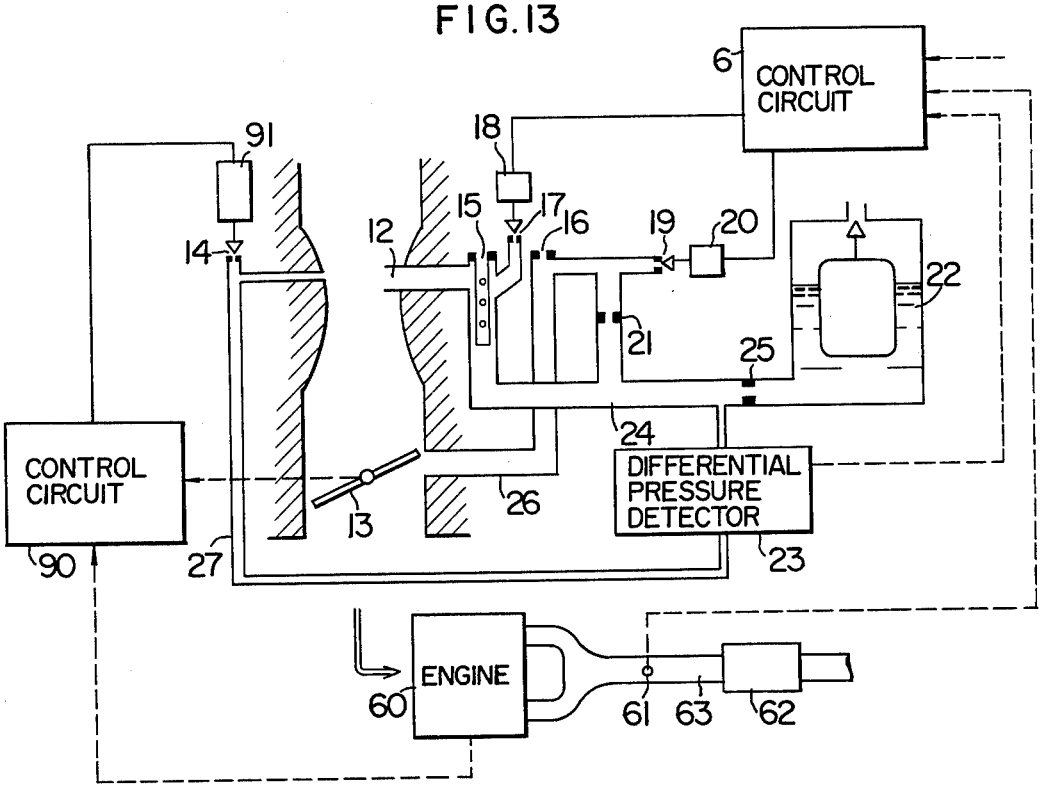
FIG. 13 shows a still further embodiment of the air to fuel ratio control system of the present invention.

FIG. 13 shows a further embodiment of the air to fuel ratio control system of the present invention. The present embodiment includes means for altering the setting of the air to fuel ratio depending on the operating condition. While FIG. 13 shows the embodiment in which means for altering the preset air to fuel ratio is added to the control system shown in FIG. 10, it should be understood that the preset air to fuel ratio altering means may be added to the control systems shown in FIGS. 2 and 9. The preset air to fuel ratio altering means comprises a control circuit 90 and an air to fuel ratio setting actuator 91 for controlling an opening area of the venturi vacuum relieving air bleed 14 in response to a control signal from the control circuit 90. Since the change of the opening area of the venturi vacuum relieving air bleed 14 results in the change of the value C in the equations (1) and (5), the air to fuel ratio setting can be changed. The control circuit 90 detects the aperture of the throttle valve 13 and the r.p.m. of the engine and controls the actuator 91 so that it establishes an air to fuel ratio desired for an operation region corresponding to the detected throttle valve aperture and engine r.p.m.

Figure 14:
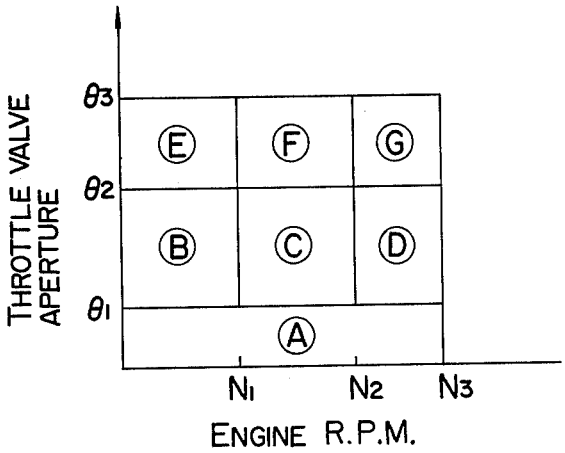
FIG. 14 is a chart for illustrating an engine operating region by an engine r.p.m. and an aperture of a throttle valve.

FIG. 14 shows a chart in which seven operation regions A–G are defined by the throttle valve aperture and the engine r.p.m.

Figure 15:
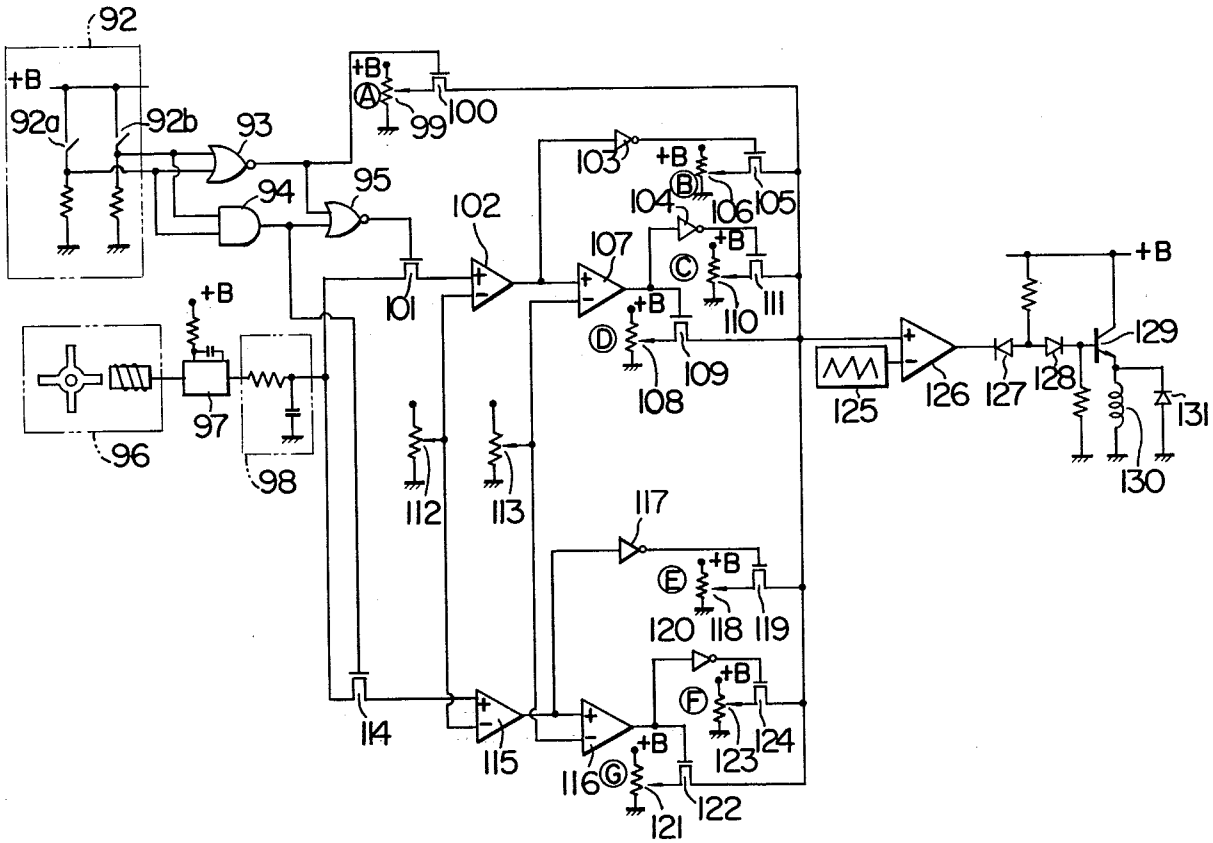
FIG. 15 shows an embodiment of an air to fuel ratio setting modification control circuit of the air to fuel ratio control system shown in FIG. 13.

FIG. 15 shows an embodiment of the control circuit 90 in the embodiment shown in FIG. 13. A throttle valve aperture detector 92 includes microswitches 92*a* and 92*b* attached to a shaft of the throttle valve, and one terminal of each microswitch is grounded through a resistor while the other terminal is connected to a power supply. The microswitches 92*a* and 92*b* are so arranged that they are sequentially turned on as the throttle valve aperture increases. Namely, when the throttle valve aperture is small, both the microswitches 92*a* and 92*b* are open, when the throttle valve aperture is medium, the microswitch 92*a* is closed, and when the aperture is large, both the microswitches 92*a* and 92*b* are closed. The junction nodes of the respective microswitches and the respective resistors are connected to a NOR gate 93 and an AND gate 94 so that when the microswitch is closed a voltage acrss the corresponding resistor is applied to those gates. An output of the NOR gate 93 is applied to a gate electrode of a MOS FET switch 100 and a NOR gate 95 while a output of the AND gate 94 is applied to a gate electrode of a MOS FET switch 113 and the NOR gate 95. An output of the NOR gate 95 is applied to a gate electrode of a MOS FET switch 101. on the other hand, the engine r.p.m. is detected by an r.p.m. detector 96 having for example a magnetic pickup, an output of which is applied to a monostable multivibrator 97, thence to a filtering circuit 98 to produce an analog voltage proportional to the r.p.m. This analog voltage is applied to source electrodes of the MOS FET switches 101 and 114. Constant voltage generators 99, 106, 110, 108, 118, 123 and 121 generate voltages $V_A$–$V_G$, respectively, which correspond to air to fuel ratios to be established to the operation regions A–G, respectively.

When the throttle valve aperture is small (in region A in FIG. 14), the NOR gate 93 produces an output which renders the MOS FET switch 100 conductive so that the voltage $V_A$ of the cnstant voltage generator 99 is applied to a positive terminal of a comparator 126. When the throttle valve aperture is medium, the NOR gate 95 produces an output which renders the MOS FET switch 101 conductive so that the analog voltage from the filtering circuit 98 is applied to a positive terminal of a comparator 102. A minus terminal of the comparator 102 receives the constant voltage from the constant voltage generator 112, which voltage corresponds to r.p.m. $N_1$ in FIG. 14. The comparator 102 produces a low level output when the r.p.m. is smaller than $N_1$ so that the MOS FET switch 105 is rendered conductive through a NOT circuit 103. Thus, when the r.p.m. is smaller than $N_1$ (in region B in FIG. 14), the voltage $V_B$ of the constant voltage generator 106 is applied to the positive terminal of the comparator 126. The output of the comparator 102 is also applied to a positive terminal of a comparator 107, a negative terminal of which receives the constant voltage from the constant voltage generator 113. This voltage corresponds to r.p.m. $N_2$ in FIG. 14. The comparator 107 produces a low level output when the r.p.m. is smaller than $N_2$ (in region C in FIG. 14) to render the MOS FET switch 111 conductive through a NOT circuit 104. As a result, the voltage $V_C$ of the constant voltage generator 110 is applied to the positive terminal of the comparator 126. When the r.p.m. is larger than $N_2$ (in region D in FIG. 14), the comparator 107 produces a high level output to render the MOS FET switch 109 conductive so that the voltage $V_D$ of the constant voltage generator 108 is applied to the positive terminal of the comparator 126. When the throttle valve aperture is large, the AND gate 94 produces an output which renders the MOS FET switch 114 conductive so that the analog voltage (r.p.m. signal) from the filtering circuit 98 is applied to the positive terminal of the comparator 115, the negative terminal of which receives the constant voltage from the constant voltage generator 112. Thus, when the r.p.m. is smaller than $N_1$ (in region E in FIG. 14), the MOS FET switch 119 conducts so that the voltage $V_E$ of the constant voltage generator 118 is applied to the positive terminal of the comparator 126. The output of the comparator 115 is applied to the positive terminal of the comparator 116, the negative terminal of which receives the constant voltage from the constant voltage generator 113. Thus, when the r.p.m. is smaller than $N_2$ (in region F in FIG. 14), the MOS FET switch 124 conducts so that the voltage $V_F$ of the constant voltage generator 123 is applied to the positive terminal of the comparator 126, and when the r.p.m. is larger than $N_2$ (in region G in FIG. 14), the MOS FET switch 122 conducts so that the voltage $V_G$ of the constant voltage generator 121 is applied to the positive terminal of the comparator 126. The negative terminal of the comparator 126 receives a ramp wave signal from a ramp wave signal generator 125. Therefore, the comparator 126 produces a square wave voltage signal having a high level duration which is proportional to the voltage applied to the positive terminal thereof. This square wave voltage signal is applied to a base of a transistor 129 where it is amplified to drive an on-off solenoid valve 130, which corresponds to the actuator 91 shown in FIG. 13 and closes the opening of the venturi vacuum relieving air bleed 14 during the high level period of the output of the comparator 126. Since the change of the ratio of open period to closed period of the air bleed 14 essentially leads to the change of the opening area $A_2$ of the air bleed 14, the value C can be changed. Accordingly, the air to fuel ratio setting can be changed in accordance with the operating condition of the engine. While the on-off solenoid valve is used in the present embodiment, a proportional solenoid valve may be used. In this case, instead of the components 125–131, the arrangement of the transistor 44, the proportional solenoid 45 and the diode 46 shown in FIGS. 5 and 12 may be used.

The exhaust gas sensor 61 may conveniently a zirconia oxygen sensor which produces a stepwise output for the exhaust gas composition having the air to fuel ratio of 14.7 which is considered to be an optimum air to fuel ratio. Namely, the zirconia oxygen sensor produces a substantially constant high level output when the air to fuel ratio is smaller than approximately 14.7, and it produces a substantially constant low level output when the air to fuel ratio is larger than approximately 14.7. Thus, when the zirconia oxygen sensor is used as the exhaust sensor 61, the air to fuel ratio can be controlled to the constant value of approximately 14.7. In the embodiment of FIG. 13, therefore, where the zirconia oxygen sensor is used as the exhaust gas sensor 61, the control system using the exhaust gas sensor is released and the air to fuel ratio control is made only by the control system using the differential pressure detector 23.

Figure 16:
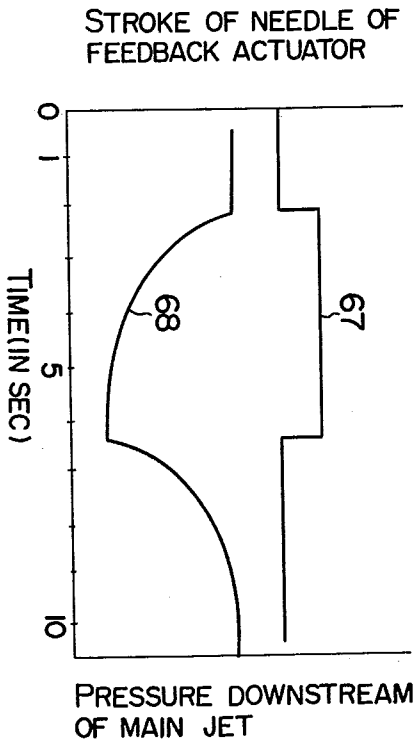
FIG. 16 is a graph showing a change in a static fuel pressure downstream of a main jet when a feedback show air bleed is opened and closed while fuel is being fed only through a slow fuel path.

FIG. 16 is a graph showing the change of the pressure Pm downstream of the main jet when the feedback slow air bleed 19 is opened and closed while the fuel is being supplied only through the slow fuel path 26, in which an abscissa represents a time and an ordinate represents a stroke of a needle of the feedback actuator 20 and the pressure downstream of the main jet. A stepwise curve 67 shows the stroke of the needle, in which a high level portion corresponds to the closed state of the feedback slow air bleed 19 and a low level portion corresponds to the open state. On the other hand, a curve 68 shows the change of the pressure Pm downstream of the main jet 25. As seen, the influence of the open/closed state of the air bleed 19 to the pressure Pm is slow.

Figure 17:
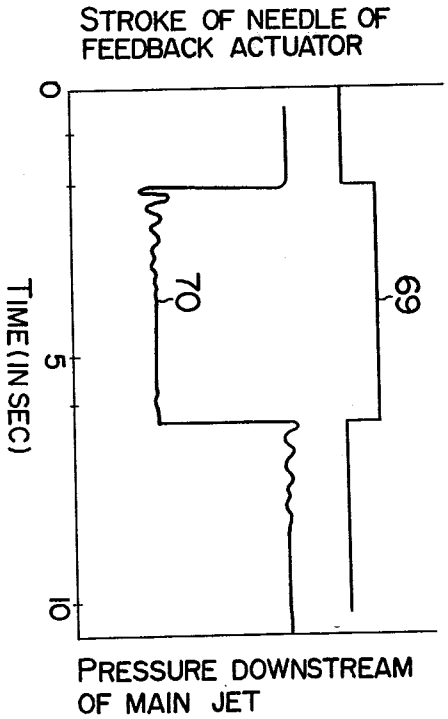
FIG. 17 is a graph showing a change in the static fuel pressure downstream of the main jet when a feedback main air bleed is opened and closed while fuel is being fed through a main fuel path.

FIG. 17 is a graph showing the change of the pressure Pm downstream of the main jet when the feedback main air bleed 17 is opened and closed while the fuel is being supplied through the main fuel path 24, in which an abscissa represents a time and an ordinate represents a stroke of a needle of the feedback actuator 18 and the pressure downstream of the main jet. A stepwise curve 69 shows the stroke of the needle in which a high level portion corresponds to the closed state of the feedback main air bleed 17 and a low level portion corresponds to the open state. A curve 70 shows the change of the pressure Pm downstream of the main jet. It rapidly follows the open/closed state of the air bleed 17.

From FIGS. 16 and 17, it is seen that the fuel flow rate supplied to the carburetor can be immediately detected by the pressure Pm downstream of the main jet when the fuel is supplied through the main fuel path, but when the fuel is supplied only through the slow fuel path, the pressure Pm downstream of the main jet does not coincide with the fuel flow rate supplied to the carburetor for about two seconds after the air bleed 19 has been opened or closed. This is due to the fact that the fuel in the vertical portion of the main fuel path backflows by the vacuum downstream of the throttle valve. This phenomenon deteriorates the control precision. In order to overcome the above drawback, it is necessary to prevent the fuel level in the main fuel path to which an air-fuel mixing tube is mounted from being varied.

Figure 18:
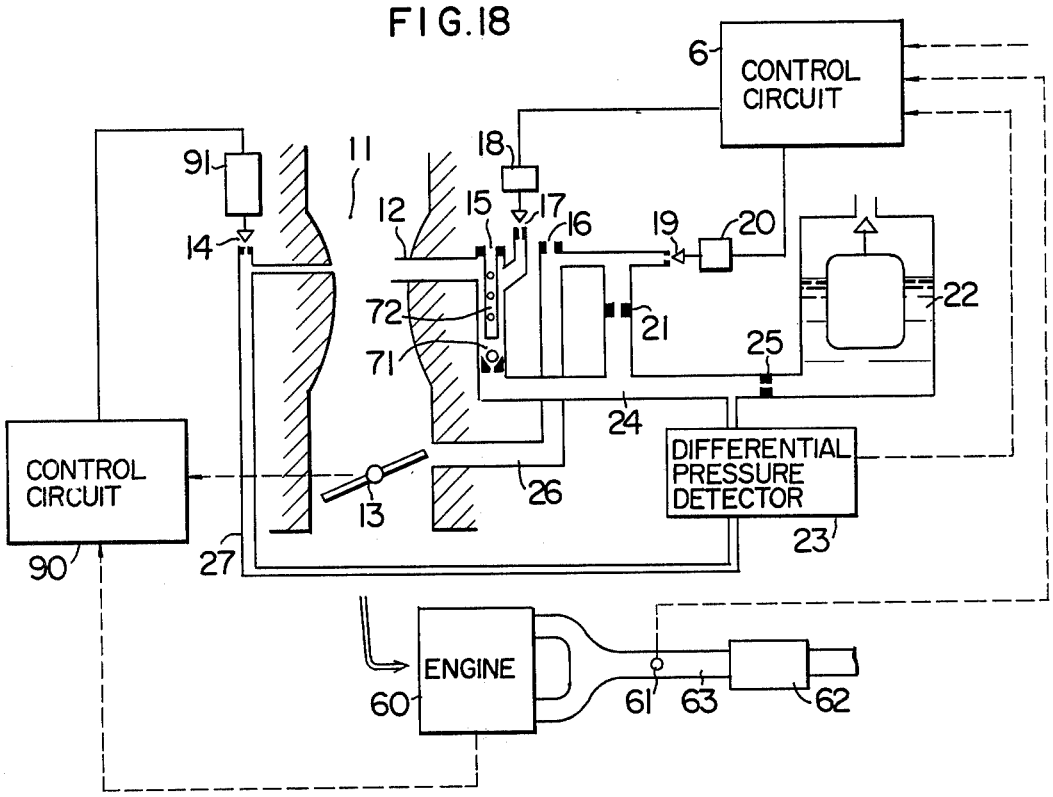
FIG. 18 shows a still further embodiment of the air to fuel ratio control system of the present invention.

FIG. 18 shows a modification of the air to fuel ratio control system when in FIG. 13. A difference from FIG. 13 resides in that a check valve 71 is mounted at a bottom of the vertical portion of the main fuel path 24 to which an air-fuel mixing tube 72 is inserted. The check valve 71 comprises a contraction and a ball mounted thereon. It presents the downward flow of the fuel stored in the vertical portion but it does not impede the upward flow of the fuel. Accordingly, even when the fuel is supplied to the carburetor only through the slow fuel path, the pressure Pm downstream of the main jet rapidly responds to the open/closed state of the feedback slow air bleed 19 so that the fuel flow rate responds to the change of the opening area of the feedback slow air bleed 19. The air to fuel ratio control system of the present embodiment thus can attain rapid and precise control even when the fuel is supplied only through the slow fuel path.

While FIG. 18 shows the modification of the air to fuel ratio control system of FIG. 13 in which the check valve 71 is provided, it should be understood that the check valve 71 in the present embodiment may be similarly incorporated in the air to fuel ratio control systems of other embodiments shown and described previously.

Figure 19:
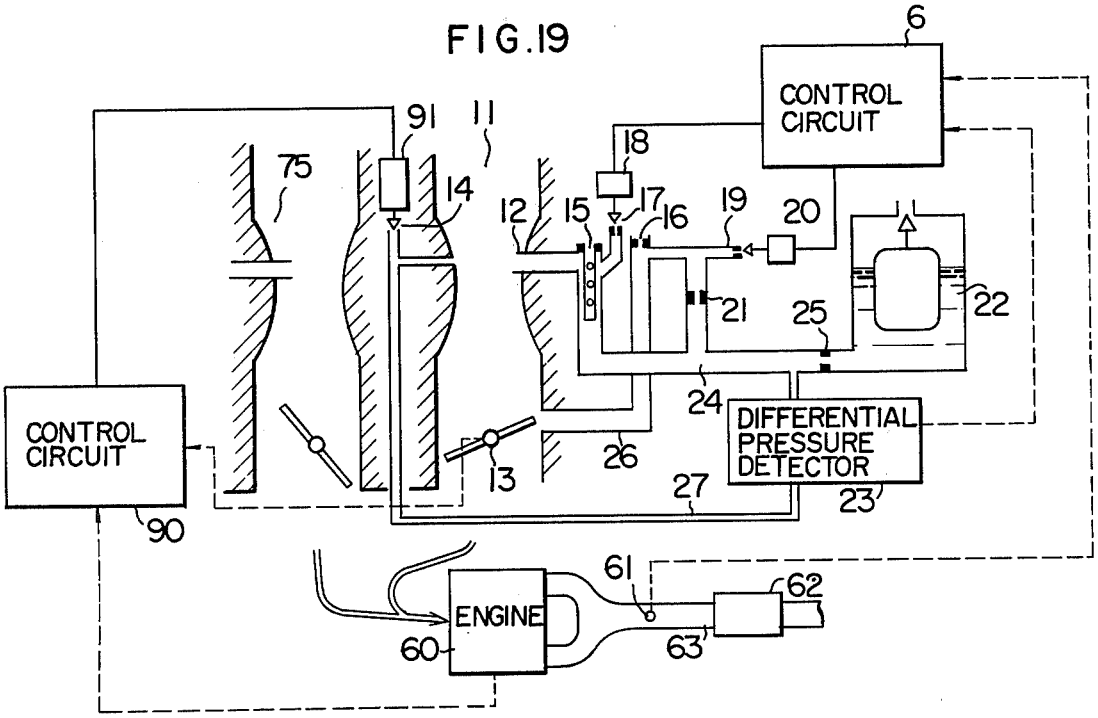
FIG. 19 shows a still further embodiment of the air to fuel ratio control system of the present invention.

FIG. 19 shows a still further embodiment of the air to fuel ratio control system of the present invention. The present embodiment shows an application in which the control system of FIG. 13 is applied to a double bore type fixed venturi carburetor. In this case, since a secondary suction tube 75 is used only in a limited operation region such as a high speed operation, it is not included in the air to fuel ratio control loop. Composition of exhaust gas resulting from entire air and fuel supplied to the engine from a primary suction tube 11 and the secondary suction tube 75 is detected by the exhaust gas sensor 61, and based on the signal from the sensor 61 the air to fuel ratio in the primary suction tube 11 is controlled. The other operations are similar to those of the control system shown in FIG. 13.

In the above-described embodiments, an atmospheric pressure relieved from a venturi vacuum and a static fuel pressure downstream of the main jet are compared directly, and a signal corresponding to a difference between the two pressures is fed to the control circuit 6. However, the same controlling effect can be obtained by detecting an atmospheric pressure within the venturi and a static fuel pressure downstream of the main jet individually, feeding signals corresponding respectively to the atmospheric pressure and the static fuel pressure to the control circuit 6, and comparing the two signals in the control circuit 6.

Figure 20:
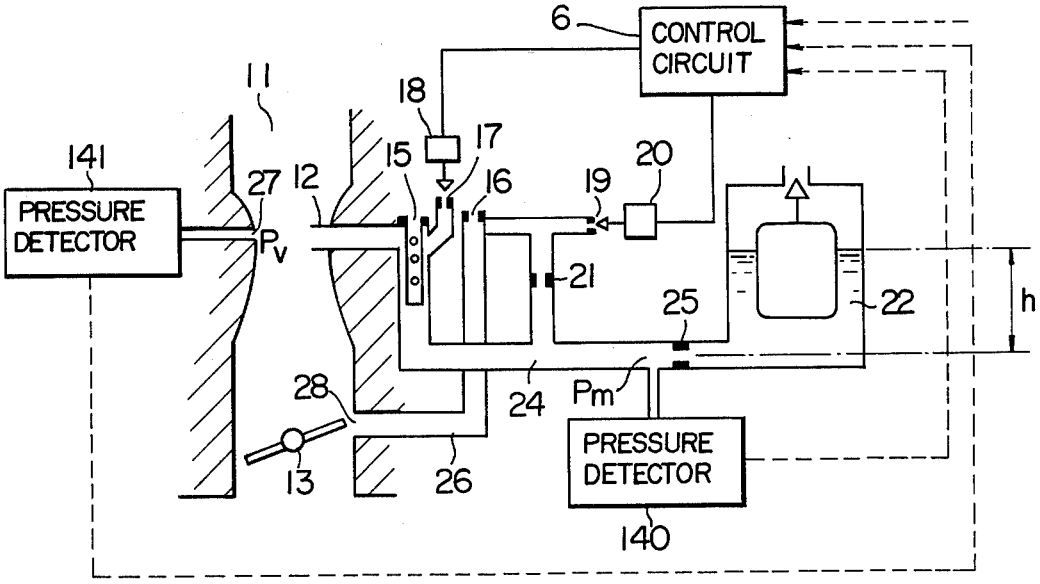
FIG. 20 shows a still further embodiment of the air to fuel ratio control system of the present invention.
Figure 21:
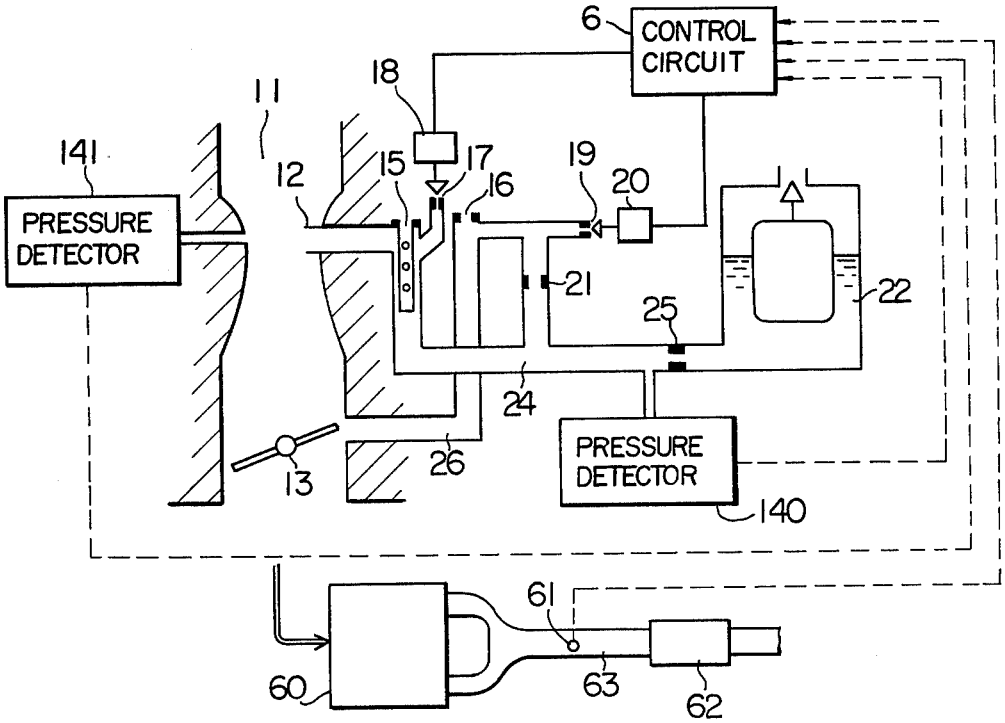
FIG. 21 shows a still further embodiment of the air to fuel ratio control system of the present invention.

FIG. 20 shows a further embodiment of the air to fuel ratio control system of the present invention. In this embodiment, an atmospheric pressure within the venturi and a static fuel pressure downstream of the main jet are detected individually. Although FIG. 20 depicts an modification of the embodiment of FIG. 2, the embodiment of FIG. 10 can be modified similarly according to the present embodiment, as shown in FIG. 21. Each of the pressure detectors 140 and 141 may be composed of a semiconductor pressure sensor with a silicon diaphram. The pressure sensors 140 and 141 produce electrical signals representative of the atmospheric pressure and the static fuel pressure, respectively.

Figure 22:
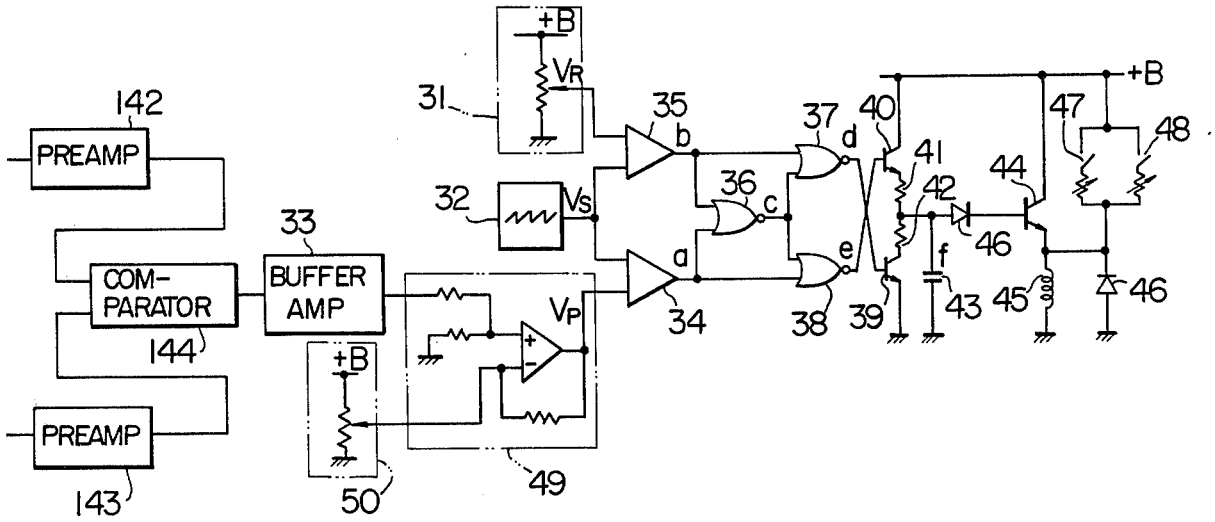
FIG. 22 shows an embodiment of a control circuit of the air to fuel ratio control system shown in FIG. 20.

FIG. 22 shows an embodiment of the control circuit 6 used in the embodiment of FIG. 20, which is a modification of the circuit shown in FIG. 3. The electrical signals produced by the pressure detectors 140 and 141 are subjected to level adjustment through respective preamplifiers 142 and 143 and fed to a comparator 144. The comparator 144 produces an output signal in accordance with a difference between the two input signals. The output signal of the comparator 144 corresponds to P-Pm and is delivered to the buffer amplifier 33. The other operation of the circuit is the same as explained with reference to FIG. 3. In this embodiment, the preamplifiers 142 and 143 effect level adjustment of the produced electrical signals, and therefore the venturi vacuum relieving air bleed 14 shown in FIG. 2 is not necessary.

Figure 23:
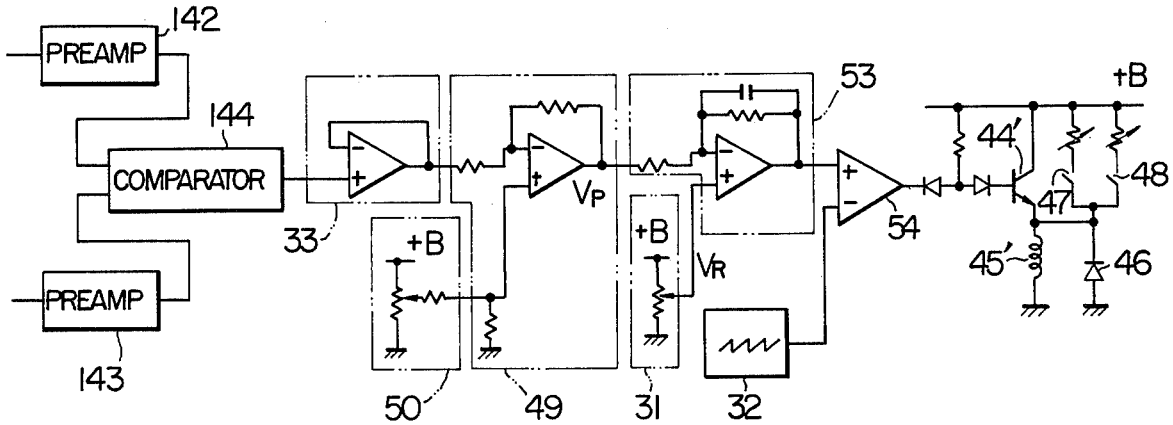
FIG. 23 shows another embodiment of a control circuit of the air to fuel ratio control system shown in FIG. 20.

FIG. 23 shows another embodiment of the control circuit 6 used in the embodiment of FIG. 20, which is a modification of the circuit shown in FIG. 8 for showing use of an on-off solenoid valve 45'. It will easily be understood that the control circuit 6 in the embodiment of FIG. 21 may be constructed by inserting the preamplifiers 142 and 143, and the comparator 144 into the circuits shown in FIGS. 11 and 12. Also, it will be apparent that the check valve 71 may be incorporated in the air fuel ratio control systems shown in FIGS. 20 and 21.

We claim:

1. An air to fuel ratio control system for an internal combustion engine having a fixed venturi type carburetor, including a main fuel path connecting a nozzle opened to a venturi of a suction tube to a bottom of a float chamber and having a main jet and a main air bleed, and a slow fuel path connecting an opening formed near a throttle valve of said suction tube to an area of said main fuel path downstream of said main jet and having a slow jet and a slow air bleed; said air to fuel ratio control system comprising a feedback main air bleed provided in said main fuel path in parallel with said main air bleed, a feedback slow air bleed provided in said slow fuel path in parallel with said slow air bleed, means for establishing an air to fuel ratio setting, means for extracting a pressure corresponding to a relieved vacuum at said venturi, means for extracting a fuel static pressure downstream of said main jet, detecting means for detecting a difference between the extracted pressures, and controlling means for controlling opening areas of said feedback main air bleed and said feedback slow air bleed in accordance with an output from said detecting means to attain the preset air to fuel ratio.

2. An air to fuel ratio control system according to claim 1, wherein said detecting means includes a device for generating a signal representative of the differential pressure, and said controlling means includes a device for generating a first predetermined reference signal, a control device for comparing the signal produced from said detecting means with said reference signal to produce a control signal representative of a difference therebetween, and an actuator responsive to an applied electrical signal to change said opening areas of said feedback main air bleed and said feedback slow air bleed, said actuator being supplied with said control signal.

3. An air to fuel ratio control system according to claim 2, wherein said controlling means includes a subtractor for subtracting a constant value from the output signal of said detecting means.

4. An air to fuel ratio control system according to claim 2 or 3, wherein said controlling means includes a device responsive to a temperature of coolant of said engine to supply a predetermined electrical signal to said actuator when the temperature of said coolant is below a predetermined temperature, and a device responsive to an aperture of said throttle valve to supply a predetermined electrical signal to said actuator when the aperture of said throttle valve is within a predetermined range of aperture whereby said actuator being rendered insensitive to said control signal by said predetermined electrical signals.

5. An air to fuel ratio control system according to claim 4, wherein said main fuel path includes a device for preventing backflow of fuel at a predetermined position along said main fuel path.

6. An air to fuel ratio control system according to claim 4, wherein said actuator includes a proportional solenoid valve.

7. An air to fuel ratio control system according to claim 4, wherein said actuator includes an on-off type solenoid valve.

8. An air to fuel ratio control system according to claim 2 further comprising means for detecting composition of exhaust gas of said engine to produce a signal representative of the composition of the exhaust gas, wherein said controlling means further includes a device for generating a second predetermined reference signal, a device for producing an auxiliary control signal representative of a difference between the signal from said exhaust gas composition detecting device and said second reference signal, and a device for adding said auxiliary control signal to said control signal.

9. An air to fuel ratio control system according to claim 8, wherein said controlling means includes a subtractor for subtracting a constant value from the output signal of said detecting means.

10. An air to fuel ratio control system according to claim 8 or 9, wherein said controlling means includes a device responsive to a temperature of coolant of said engine to supply a predetermined electrical signal to said actuator when the temperature of said coolant is below a predetermined temperature, and a device responsive to an aperture of said throttle valve to supply a predetermined electrical signal when the aperture of said throttle valve is within a predetermined range of aperture, whereby said actuator is rendered insensitive to said control signal by said predetermined electrical signals.

11. An air to fuel ratio control system according to claim 10, wherein said main fuel path includes a device for preventing backflow of the fuel at a predetermined position along said main fuel path.

12. An air to fuel ratio control system according to claim 10, wherein said actuator includes a proportional solenoid valve.

13. An air to fuel ratio control system according to claim 10, wherein said actuator including an on-off type solenoid valve.

14. An air to fuel ratio control system according to claim 1, wherein said detecting means includes a diaphragm valve having a first chamber on one side of a diaphragm for receiving said pressure corresponding to said relieved venturi vacuum and a second chamber on the other side of the diaphragm for receiving a static fuel pressure downstream of said main jet, and said controlling means includes a needle linked to said diaphragm and arranged to oppose to said feedback main air bleed and said feedback slow air bleed.

15. An air to fuel ratio control system according to claim 14, wherein said second chamber for receiving the fuel static pressure is provided with a compressed spring, a compression force of said compressed spring being added to said fuel static pressure.

16. An air to fuel ratio control system according to claim 15, wherein said main fuel path includes a device for preventing backflow of fuel at a predetermined position along said main fuel path.

17. An air to fuel ratio control system according to claim 1, 2, 8 or 14 further comprising means responsive to the aperture of said throttle valve and engine r.p.m. to control said means for establishing the air to fuel ratio for altering the preset air to fuel ratio.

18. An air to fuel ratio control system according to claim 17, wherein said controlling means includes a subtractor for subtracting a constant value from the output signal of said detecting means.

19. An air to fuel ratio control system according to claim 18, wherein said controlling means includes a device responsive to a temperature of coolant of said engine to supply a predetermined temperature, and a device responsive to an aperture of said throttle valve to supply a predetermined electrical signal to said actuator when the aperture of said throttle valve is within a predetermined range of aperture whereby said actuator being rendered insensitive to said control signal by said predetermined electrical signals.

20. An air to fuel ratio control system according to claim 19, wherein said main fuel path includes a device for preventing backflow of fuel at a predetermined position along said main fuel path.

21. An air to fuel ratio control system according to claim 19, wherein said actuator includes a proportional solenoid valve.

22. An air to fuel ratio control system according to claim 19, wherein said actuator includes an on-off type solenoid valve.

23. An air to fuel ratio control system according to claim 17, wherein said means for extracting the pressure corresponding to the relieved vacuum at said venturi includes an air flow path connecting said venturi to said detecting means and provided with an air bleed, said means for establishing the air to fuel ratio consists of said air bleed provided in said air flow path, and said means for altering the air to fuel ratio includes a detector for producing a signal indicative of an aperture of said throttle valve, a detector for generating a signal indicative of an engine r.p.m., a device responsive to said throttle valve aperture signal and said engine r.p.m. signal to produce a predetermined signal for establishing the air to fuel ratio, a device responsive to said air to fuel ratio establishing signal to produce an air to fuel ratio establishing control signal, and an actuator responsive to said air to fuel ratio establishing control signal to change an opening area of said air bleed in said air flow path.

24. An air to fuel ratio control system according to claim 23, wherein the last mentioned actuator includes a proportional solenoid valve.

25. An air to fuel ratio control system according to claim 23, wherein the last mentioned actuator includes an on-off type solenoid valve.

26. An air to fuel ratio control system for an internal combustion engine having a fixed venturi type carburetor, including a main fuel path connecting a nozzle opened to a venturi of a suction tube to a bottom of a float chamber and having a main jet and a main air bleed, and a slow fuel path connecting an opening formed near a throttle valve of said suction tube to an area of said main fuel path downstream of said main jet and having a slow jet and a slow air bleed; said air to fuel ratio control system comprising a feedback main air bleed provided in said main fuel path in parallel with said main air bleed, a feedback slow air bleed provided in said slow fuel path in parallel with said slow air bleed, means for producing a signal in accordance with a pressure at said venturi, means for producing a signal in accordance with a fuel static pressure downstream of said main jet, and controlling means for controlling opening areas of said feedback main air bleed and said feedback slow air bleed in accordance with a difference between said two signals to attain a predetermined air to fuel ratio.

27. An air to fuel ratio control system according to claim 26, wherein said controlling means includes a device for comparing said two signals and producing an output signal representative of a difference between said two signals, a device for generating a first predetermined reference signal, a control device for comparing said output signal with said reference signal to produce a control signal representative of a difference therebetween, and an actuator responsive to an applied electrical signal to change said opening areas of said feedback main air bleed and said feedback slow air bleed, said actuator being supplied with said control signal.

28. An air to fuel ratio control system according to claim 27, wherein said controlling means includes a subtractor for subtracting a constant value from the output signal of said detecting means.

29. An air to fuel ratio control system according to claim 27 or 28, wherein said controlling means includes a device responsive to a temperature of coolant of said engine to supply a predetermined electrical signal to said actuator when the temperature of said coolant is below a predetermined temperature, and a device responsive to an aperture of said throttle valve to supply a predetermined electrical signal to said actuator when the aperture of said throttle valve is within a predetermined range of aperture whereby said actuator being rendered insensitive to said control signal by said predetermined electrical signals.

30. An air to fuel ratio control system according to claim 29, wherein said main fuel path includes a device for preventing backflow of fuel at a predetermined position along said main fuel path.

31. An air to fuel ratio control system according to claim 29, wherein said actuator includes a proportional solenoid valve.

32. An air to fuel ratio control system according to claim 29, wherein said actuator includes an on-off type solenoid valve.

33. An air to fuel ratio control system according to claim 27 further comprising means for detecting composition of exhaust gas of said engine to produce a signal representative of the composition of the exhaust gas, wherein said controlling means further includes a device for generating a second predetermined reference signal, a device for producing an auxiliary control signal representative of a difference between the signal from said exhaust gas composition detecting device and said second reference signal, and a device for adding said auxiliary control signal to said control signal.

34. An air to fuel ratio control system according to claim 33, wherein said controlling means includes a subtractor for subtracting a constant value from the output signal of said detecting means.

35. An air to fuel ratio control system according to claim 33 or 34, wherein said controlling means includes a device responsive to a temperature of coolant of said engine to supply a predetermined electrical signal to said actuator when the temperature of said coolant is below a predetermined temperature, and a device responsive to an aperture of said throttle valve to supply a predetermined electrical signal when the aperture of said throttle valve is within a predetermined range of aperture, whereby said actuator is rendered insensitive to said control signal by said predetermined electrical signals.

36. An air to fuel ratio control system according to claim 35, werein said main fuel path includes a device for preventing backflow of the fuel at a predetermined position along said main fuel path.

37. An air to fuel ratio control system according to claim 35, wherein said actuator includes a proportional solenoid valve.

38. An air to fuel ratio control system according to claim 35, wherein said actuator including an on-off type solenoid valve.

* * * * *